United States Patent [19]

Bory et al.

[11] 4,248,577

[45] Feb. 3, 1981

[54] SPINNERET ASSEMBLY

[75] Inventors: Alain Bory, Lyon; Jean Pommier, Sainte-Foy-les-Lyon, both of France

[73] Assignee: Rhone-Poulenc Textile, Paris, France

[21] Appl. No.: 915,232

[22] Filed: Jun. 13, 1978

[30] Foreign Application Priority Data

Jun. 14, 1977 [FR] France ..... 77 18438

[51] Int. Cl.[3] ..... B29F 3/04

[52] U.S. Cl. ..... 425/131.5; 264/176 F; 264/177 F; 425/382.2; 425/462; 425/463; 425/464

[58] Field of Search ..... 425/461, 382.2, 462–464, 425/131.5; 264/177 F, 176 F

[56] References Cited

U.S. PATENT DOCUMENTS

| | | | |
|---|---|---|---|
| 1,310,509 | 7/1919 | Specht | 425/464 |
| 2,077,373 | 4/1937 | Formhals | 425/461 |
| 2,740,986 | 4/1956 | Lipscomb et al. | 425/461 |
| 3,121,254 | 2/1964 | Heyner et al. | 425/464 |
| 3,302,238 | 2/1967 | Medeiro | 425/461 |
| 3,888,610 | 6/1975 | Brackmann et al. | 425/464 |
| 3,909,181 | 9/1975 | Wuhrmann et al. | 425/461 |
| 3,938,925 | 2/1976 | Lees | 425/464 |
| 4,102,625 | 8/1977 | Luthi et al. | 425/464 |

FOREIGN PATENT DOCUMENTS

| | | | |
|---|---|---|---|
| 647913 | 12/1928 | France | 425/464 |
| 1513182 | 2/1968 | France . | |
| 2215490 | 8/1974 | France . | |
| 629397 | 12/1961 | Italy | 425/464 |
| 45-3289 | 2/1970 | Japan | 425/464 |
| 580466 | 9/1946 | United Kingdom | 425/464 |
| 494449 | 12/1973 | U.S.S.R. | 425/464 |

*Primary Examiner*—Jay H. Woo

*Attorney, Agent, or Firm*—Stevens, Davis, Miller & Mosher

[57] ABSTRACT

A spinneret assembly is disclosed that comprises thin individual spinnerets simultaneously exhibiting a great mechanical resistance to pressure and a great number of orifices, in which:

the relation between the total piercing area and the total surface of the assembly is between 35% and 90%;

the relation between the total number of orifices and the total surface of the assembly is between 0.2 and 25 orifices per $mm^2$; and the relation between the total surface of orifices and the surface of the assembly is between 0.5% and 40%; the spinneret assembly comprising a rigid supporting plate pierced with holes designed for the passage of the spinning material, every hole being coaxially associated with an individual spinneret and having at least one portion the cross sectional area of which is less than that of the surface of the respective spinneret.

12 Claims, 27 Drawing Figures

SPINNERET ASSEMBLY

This invention relates to a spinneret comprising or constituted of an assembly of a plurality of individual spinnerets exhibiting great mechanical resistance to pressure, and comprising a great number of holes and suitable for any type of spinning process.

It also relates to ways of assemblying individual spinnerets, so that these are disposed closely adjacent to one another, the resulting assembly requiring a minimum floor space.

It is already known, according to French Application Ser. No. 2,215,490, published on Aug. 23, 1974, to spin polyacrylonitrile solutions by means of an aggregate of individual spinnerets of which the total number of holes is greater than $$\frac{1.4 \times 10^4}{\text{yarn count in tex}},$$

and wherein the relation between the total surface of all the holes and the whole surface of the aggregate is between 1% and 2%, preferably 1.4% to 1.6%. However, this French application does not describe any arrangement relating to the mounting of the individual spinnerets.

French Pat. No. 1,513,182 describes a spinneret consisting of several individual spinnerets located in the bottom plate in holes of which the diameter corresponds to that of the lower part of the spinnerets, the edge of these individual spinnerets laying against the surface of the bottom plate where it is fixed by pure gold welding. The individual spinnerets can be removed by melting the welding. However, such a process is expensive and not easy to realize. It does not allow large spinnerets to be obtained, because the supporting plate is not solid and shows some rigidity only if the individual spinnerets are sufficiently far apart, which eliminates the possibility of a great density of piercing. In addition, it is difficult to disassemble every spinneret separately.

Besides, the difficulty of making spinnerets having a great number of holes is well known. Until now, it was known to manufacture large monoblock spinnerets which could have up to about 200,000 holes, but these spinnerets are not rigid and are little resistant to pressure. In addition, they are not easily made:

piercing is delicate on account of deformations brought about by this operation and on account of the great number of holes;

their handling is difficult;

finishing, polishing and burring are difficult operations on account of the surface; and the risk of damage is higher and more expense is involved on account of the great number of holes.

Accordingly, the present invention relates to a spinneret comprising or consisting essentially of an assembly of thin individual spinnerets simultaneously having a great mechanical resistance to pressure and a great number of holes in which:

the relation between the total area of piercing and the total surface of the assembly varies between 35% and 90%;

the relation between the total number of holes and the total surface of the assembly is between 0.2 and 25 holes per mm$^2$;

the relation between the total surface of holes and the total surface of the assembly is between 0.5% and 40%; and the spinneret is made up of a rigid supporting plate pierced with holes designed for the passage therethrough of the spinning material, each of said holes being coaxially associated with one individual spinneret and having at least a zone, the cross sectional area of which is less than the surface of each individual spinneret.

Such a spinneret can have a practically unlimited number of holes within a minimum space, and still be very resistant to pressure. It may be used for all types of spinning processes, i.e., melt, semi-melt, solution spinning, etc. The number and the arrangement of holes are determined by the three following criteria:

the relation between the total piercing area and the total surface of the assembly varies between 30% and 90%, preferably between 55% and 75%. By "total piercing area" is meant the sum of the areas pierced on every individual spinneret which corresponds to the surface delimited or defined by a perimeter passing through the axes of the outer orifices of every individual spinneret;

the relation total number of holes/total surface of the assembly, which corresponds to a piercing density, is usually between 0.2 and 25 holes/mm$^2$, and preferably, for holes $<0.12$ mm in diameter, between 8 and 15 holes per mm$^2$ and for holes $>0.12$ mm in diameter, between 1.5 and 6 holes/mm$^2$; and the relation between the total surface of holes and the total surface of the assembly varies between 0.5% and 40%, and preferably between 2% and 4% for orifices $\leqq 0.12$ mm in diameter and between 8% and 16% for orifices $>0.12$ mm in diameter, which is much superior to the usual relation of the large spinnerets known up to now, and particularly much superior to that described in the French Pat. No. 2,215,490.

The maximum piercing area is obtained with individual polygonal-shaped spinnerets, that is, with individual spinnerets which are next to one another on every side.

The rigid supporting plate comprises holes coaxially associated with every individual spinneret, and provided for the passage of the spinning material and eventually for the mounting of intermediate fixing systems. These holes have at least one zone, the cross section of which is markedly less than the surface area of the individual spinneret.

The rigid supporting plate may have any desired shape. According to the spinning process type to be used, it can exhibit a flat or a curved surface for example.

The rigid supporting plate may have the desired thickness in accordance with the pressure to be applied to the spinneret and in accordance with the thermal insulation to be obtained. It can be metallic (stainless steel, for instance) or made of resistant plastics such as some types of polyamide, or made of several assembled materials, for example, plastic cast on the steel supporting plates.

Such a spinneret can be realized in several ways. A first way consists in providing intermediate holders inside the holes pierced through the rigid supporting plate, on which thin individual spinnerets are fixed, the said intermediate holders eventually being associated with an additional piece depending upon the individual spinneret shape and the type of fixing or bonding selected.

The individual holders can be fixed or attached to the rigid supporting plate in different ways, for example, by screwing, riveting, sticking or gluing, brazing, welding, joining by force or pressure (i.e., force-fit), etc.

In the case of attachment by screwing, the intermediate holders can be screwed directly into the rigid supporting plate, particularly in case of circular spinnerets since, then, blocking is carried out on the side of the inner-face of the rigid supporting plate inside the intermediate holder by means of a spanner blocking said holder. This spanner can for example be for hexagonal, 12-sided, cylindrical nuts with longitudinal grooves, with pins, etc.

The inner face of the rigid supporting plate corresponds to the inlet face of the spinning material.

In the case of polygonal-shaped individual spinnerets such as square, rectangular, triangular or hexagonal spinnerets, for example, since the individual spinnerets are next to one another and cannot rotate, an additional piece, which may have the role of a screw or a nut and allows the intermediate holder to be blocked by the inner side of the rigid supporting plate, may be used.

Blocking can be carried out either inside the supporting plate itself, or inside or outside the intermediate piece, provided, however, that the size of the efficient part of the screwing means is below that of every individual spinneret.

The outside size of the intermediate holder associated with the additional piece should be at most equal to the size of the individual spinneret so that the individual spinnerets may be near to one another, i.e., closely adjacent.

In addition, the intermediate holder comprises a central bore for the passage of the spinning material of which the section is very clearly less than the surface of the individual spinneret, and gradually increases on coming nearer to it to reach the size of the individual spinneret on the level of this individual spinneret.

The individual spinnerets are fixed without additional space, for example, by direct setting of the individual spinneret on the intermediate holder and by using a set ring. Other known means, such as sticking or welding, may also be suitable. In this way, the maximum space required by the total intermediate holder-individual spinneret assembly is not greater than that of the spinneret alone.

A second way of obtaining such an assembly of individual spinnerets consists in making the spinning material flow without intermediate holder directly through the holes pierced in the rigid supporting plate, these holes, in any case, having at least one zone in the section of which is less than their section at the individual spinneret level and less than the surface of the individual spinneret itself. Thin individual spinnerets may be fixed or attached directly inside the hole made in the rigid supporting plate, for example by sticking, welding, etc. In this case, it is also possible to provide a very thin spinneret plate pierced in places corresponding to each hole of the rigid supporting plate and simply stuck or welded on the rigid supporting plate in the areas which are not pierced, or individual flat spinnerets also stuck or welded.

The individual spinnerets are thin type spinnerets, that is, made from metallic sheets 0.1–2 mm thick for example, of which the outer shape is generally determined by cutting out and pressing operations.

In the case of using an intermediate holder, their outside shape corresponds very exactly to that of the intermediate holder. It may be round or polygonal, for example, triangular, square, rectangular or hexagonal in shape, the polygonal shape corresponding to a possible maximum piercing.

Pierced orifices may have any desired shape such as circular, polygonal, multilobal, or Y, X, T, L, I, etc., shape, and be of different shapes on the same individual spinneret or from one individual spinneret to another.

In some spinning types, for example in the case of wet spinning, it seems suitable to improve the thermal exchanges between the spinning solution and the coagulating bath, and to improve the flow of the spinning material by canalization of the said material to be spun in front of each individual spinneret. To this end, it is possible to provide distribution cones for each individual spinneret, either in a plate or mold on the existing plate, made of plastic such as polypropylene, polyamide, etc., or within the rigid supporting plate itself, which for this purpose will be made thicker. It is also possible to insert the individual spinnerets more or less completely in the outer face of the rigid supporting plate, either by coating it with a plate or a mold on the existing plate made of the same plastics, or by providing a thicker rigid supporting plate on its outer face.

The use of distributing cones and the embedding of spinnerets may be employed simultaneously or not, as desired.

The various types of construction of the spinneret assembly according to the present invention will be still better understood with the following figures and the accompanying detailed description thereof.

FIGS. 1 to 25 illustrate the first embodiment of the invention referred to above, that is, with intermediate holder; and FIGS. 26 and 27 illustrate the second embodiment of the invention, i.e., without intermediate holder.

FIG. 1 is a sectional view of two individual spinnerets fixed on a rigid supporting plate, comprising the individual spinneret 1 itself, and the intermediate holder 2 screwed into the rigid supporting plate 3.

FIGS. 2, 3 and 4 are top views of various inside shapes of the intermediate holder 2 enabling it to be screwed into the rigid supporting plate 3 on the inner face of the spinneret by means of a spanner for hexagonal, 12-sided, or cylindrical nuts with four longitudinal grooves.

FIG. 5 is a sectional view of a mounting fixed on the rigid supporting plate by screwing by the inner face of the rigid supporting plate 3, of an intermediate forming nut piece 4, by means of a spanner introduced inside this piece, on the intermediate holder 2 supporting an individual spinneret 1.

Figure 1:
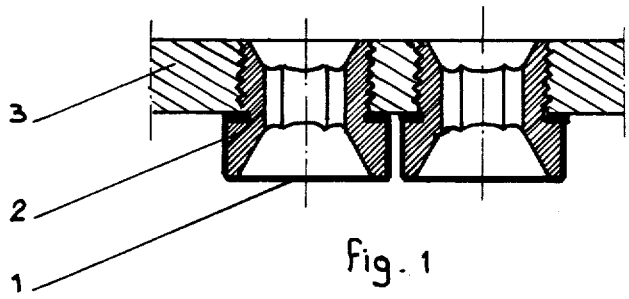
Figure 2:
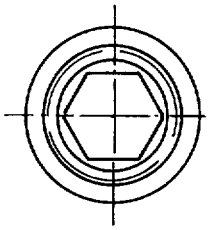
Figure 3:
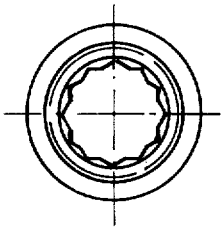
Figure 4:
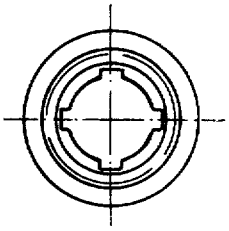
Figure 5:
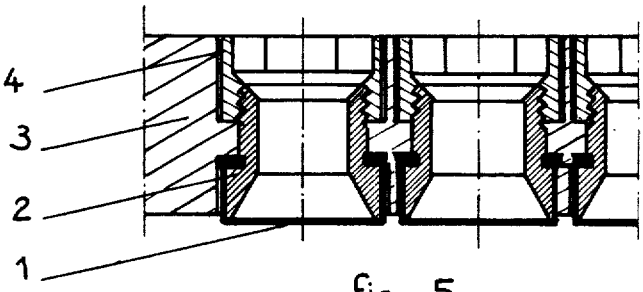
Figure 6:
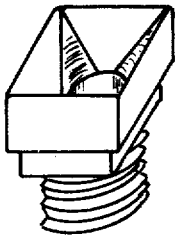
FIG. 6 is a perspective view of the intermediate holder 2 represented in FIG. 5, with outer square shape at the level of the individual spinneret.
Figure 7:
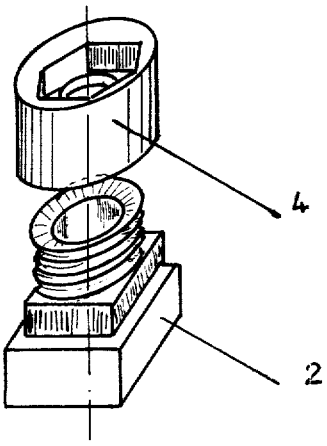
FIG. 7 is a perspective view of the intermediate holder 2 and of the intermediate piece 4 screwed onto the intermediate holder, and corresponding to FIG. 5.
Figure 8:
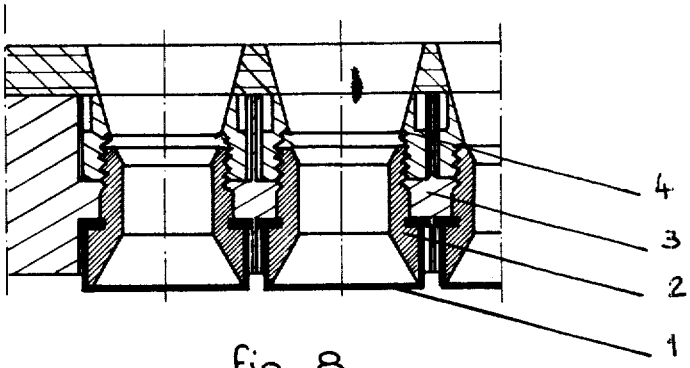

FIG. 8 is a sectional view of a mounting fixed on the rigid supporting plate 3 by screwing on the inner face of the rigid supporting plate 3 the intermediate piece 4 on the intermediate holder 2 holding the individual spinneret 1, the screwing being carried out by means of a spanner or wrench having pins engaging on the outside of the intermediate piece.

Figure 9:
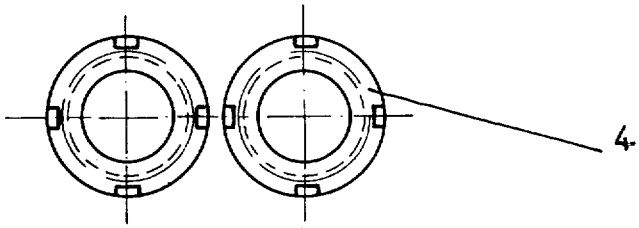

FIG. 9 is a top view of the intermediate piece 4 (of FIG. 8) fitted with notches for hooking or engaging the spanner with pins.

Figure 10:
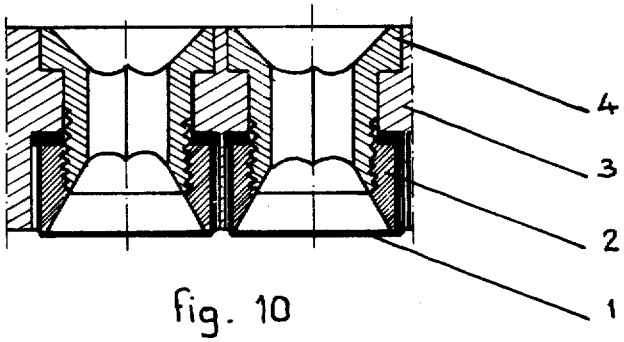

FIG. 10 is a sectional view of a mounting system comprising the individual spinneret 1 fixed on or attached to the intermediate holder 2, and an intermediate piece 4 screwed inside the intermediate holder 2 and thus becoming fixed in the rigid supporting plate 3.

Figure 11:
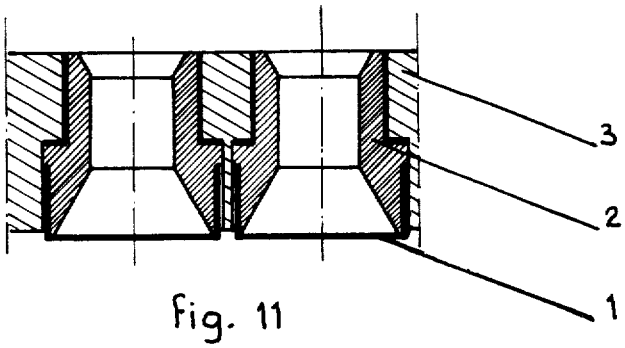
Figure 12:
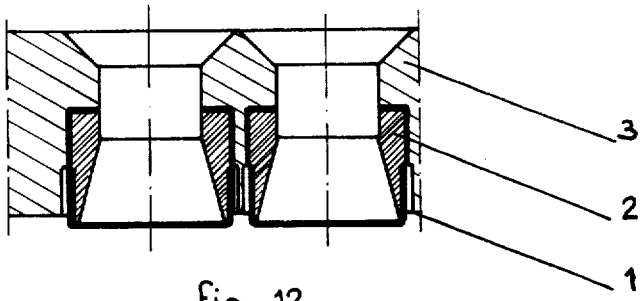

FIGS. 11 and 12 are sectional views of another way of fixing the intermediate holder 2 on the rigid supporting plate 3 by sticking or joining by forcing, in the nature of a press fit.

Figure 13:
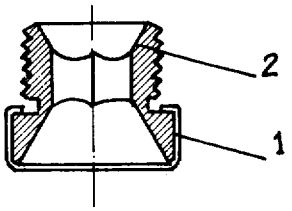

FIG. 13 is a sectional view of the assembly of an intermediate holder 2 and an individual spinneret 1, the spinneret being fixed on the intermediate holder 2 by direct setting.

Figure 14:
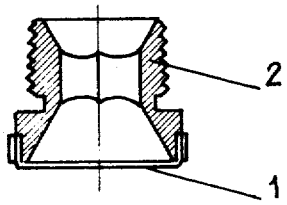

FIG. 14 is a sectional view of another assembly of an intermediate holder 2 and an individual spinneret 1, the spinneret being fixed or attached to the intermediate holder 2 by a set ring or collar.

Figure 15:
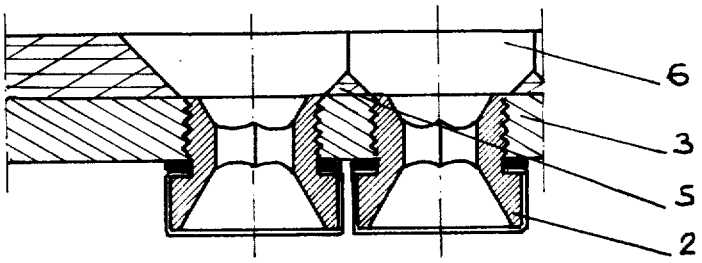

FIG. 15 is a sectional view of a spinneret assembly having a plastic plate 5 added or molded from the existing one, on the inner face of the rigid supporting plate 3, and in which there are distribution cones 6 designed for directing the spinning material to each individual spinneret.

Figure 16:
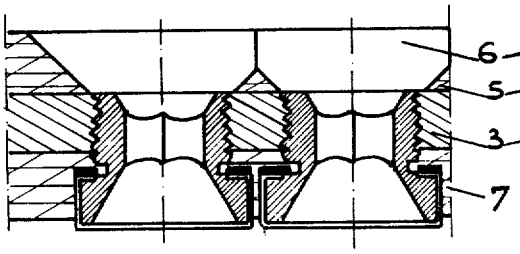

FIG. 16 also is a sectional view of a spinneret assembly comprising a plastic plate 5 added or molded from the existing one in which distribution cones 6 are provided, plus an additional plastic plate 7 molded on the first in which the individual spinnerets are completely embedded.

Figure 17:
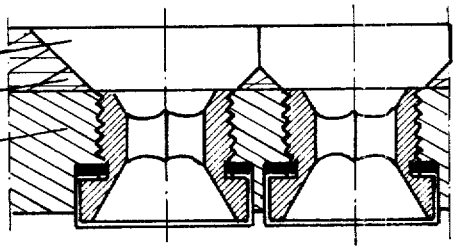

FIG. 17 is similar to FIG. 15, but has a rigid supporting plate 3 which is thicker and in which the individual spinnerets are completely embedded.

Figure 18:
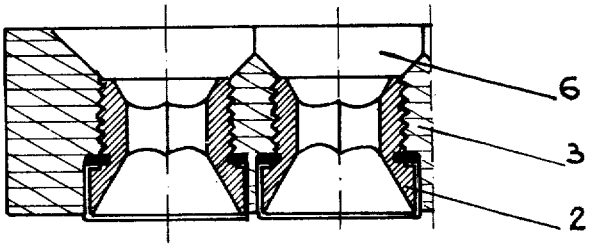
Figure 19:
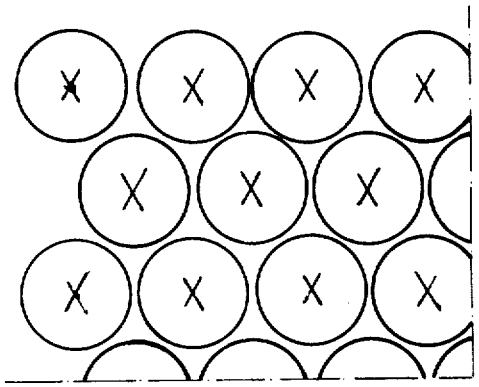
Figure 20:
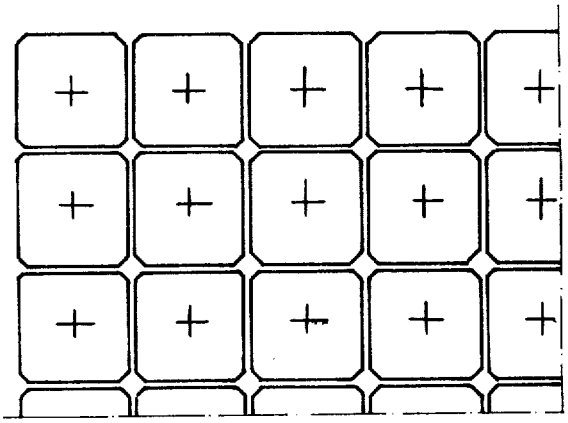
Figure 21:
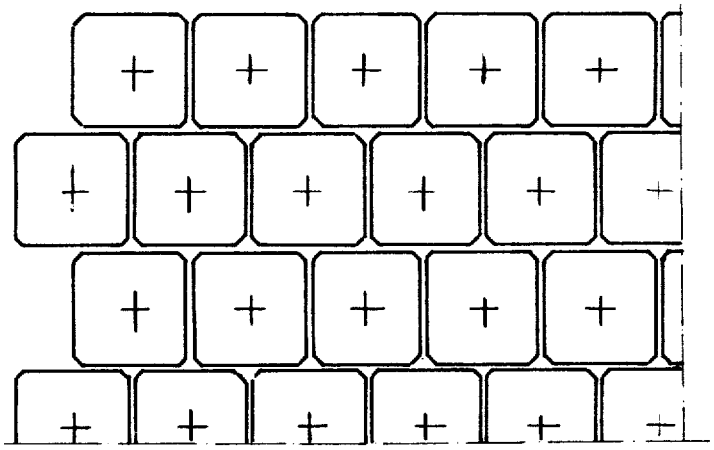
Figure 22:
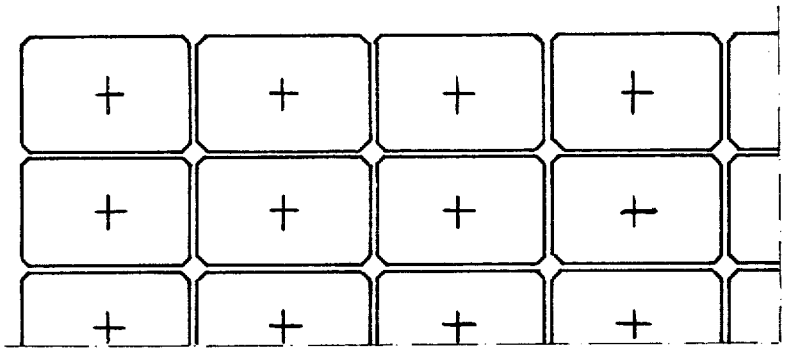
Figure 23:
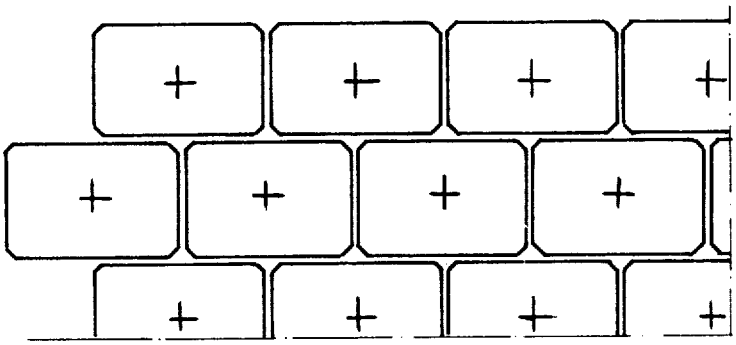
Figure 24:
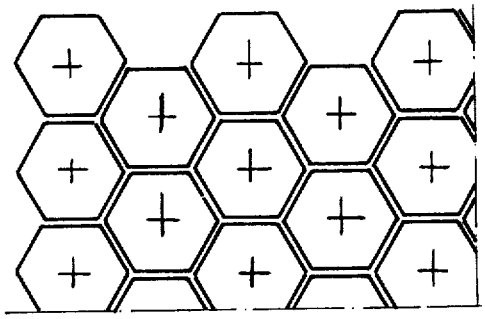
Figure 25:
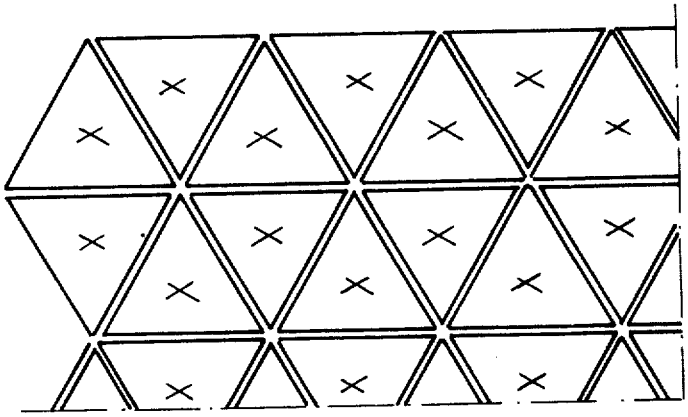

FIG. 18 is a sectional view showing a very thick rigid supporting plate 3 in which distribution cones 6 are provided on the inner face of the spinneret, and in which the intermediate holders 2 are completely embedded up to the level of the outer face of the individual spinnerets.

FIGS. 19 to 25 are bottom views of various shapes and arrangements of the individual spinnerets on the rigid supporting plate.

Figures 26, 27:
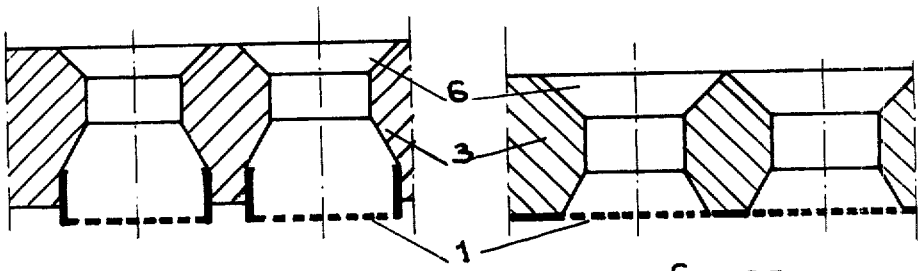

FIG. 26 is a sectional view illustrating the second way of realizing spinnerets according to the present invention, and comprises stuck, welded, or brazed individual spinnerets, the inside of the rigid supporting plate 3 and the distribution cone 6 being provided in the rigid supporting plate itself.

FIG. 27 is a sectional view of a rigid supporting plate 3 in which distribution cones 6 and a large sized, one-piece spinneret plate 1, pierced coaxially, with respect to each hole made through the rigid supporting plate 3, by a group of holes acting as an individual spinneret and stuck against or attached to the solid parts of the rigid supporting plate, are provided.

The large sized spinnerets according to the present invention exhibit many practical advantages.

They are suitable for all types of spinning processes, such as melt, semi-melt, solution, dispersion or gel spinning, etc.

They permit spinning pressures of at least 10 bars, up to 40 bars, and even higher pressures.

Of course, the strength of this type of spinneret depends upon a number of parameters for the rigid supporting plate and the individual spinnerets, for the rigid supporting plate thickness, total surface, hole size, distance between holes, for the individual spinnerets, surface of the individual spinneret, thickness, surface of the orifices, distance between the orifices, arrangement, etc.

The intermediate holder-individual spinneret assembly of the present invention requires a much smaller space than the spinneret assemblies known till now for the same number of orifices.

It is possible to make spinnerets of any shape, whilst adapting themselves easily to the type of spinning and to the equipment selected.

The individual spinnerets are easily made from tantalum, stainless steel, platinum alloy, etc., even for orifices of relatively small diameter. The thermal insulation of the assembly is good for various reasons: the intermediate holder is a solid piece which can be made of an insulating material, the rigid supporting plate can be designed thicker, to be attached or associated with a plastic plate or mold on the existing plate on one or both faces thereof.

When the individual spinnerets are mounted on an insulating supporting plate, the outstanding thermal insulation of the assembly according to the present invention allows the polymer concentration of the solution to be also increased, which consequently improves the spinning speed and the mechanical properties of the fibers thus obtained.

The production cost is much lower than for one-piece spinnerets.

The individual spinnerets are easily dismantled separately, in particular in the system of mounting with the intermediate holder, which therefore allows repairs to be readily carried out.

The spinneret assemblies of the present invention can have a practically unlimited number of holes with minimum space required, owing to the closely positioned arrangement of the individual spinnerets. For example, a large sized spinneret can be made having 252 individual round spinnerets 19 mm in diameter, each of them comprising 3,970 orifices. The required space for this assembly is 365 mm by 242 mm. The piercing characteristics are as follows:

$$\frac{\text{Total piercing area}}{\text{Total surface of the assembly}} = 60\%$$

$$\frac{\text{Total number of orifices}}{\text{Total surface of the assembly}} = 11.3 \text{ holes/mm}^2$$

$$\frac{\text{Total surface of orifice}}{\text{Total surface of the assembly}} = 2.7\%$$

$$\text{Total number of orifices} = 1{,}000{,}440$$

In some cases, they enable the spinning speed to be increased without risk of broken end production.

The following examples are given for the purpose of still better illustrating the invention, but without intending to be restrictive:

EXAMPLE 1

(A) There was spun an acrylic polymer solution, having a specific viscosity of 0.32 (measured on 2/1000 solution in the dimethylformamide, DMF, at 20° C.), and consisting of:

| | |
|---|---|
| acrylonitrile | 91% by weight |
| methyl methacrylate | 7.75% by weight |
| sodium methallyl sulfonate | 0.85% by weight |
| dissolved in DMF at the level of | 24.30% by weight |

The spinneret used is a spinneret comprising four round individual cupules next to one another of 19 mm in diameter, each of them being pierced with 3,750 orifices of 0.055 mm in diameter, the piercing characteristics of which are as follows:

The individual spinnerets are made of platinum-gold-rhodium alloy and the intermediate holders and the supporting plate are made of stainless steel.

The filaments issuing from the spinneret are coagulated in a bath containing 58% DMF and 42% water, maintained at 20° C.

Then the filaments are successively drawn in the air at a draw ratio of 2.2×, washed, relaxed, drawn in boiling water at a draw ratio of 3.47×, and dried.

The filaments thus obtained, having a count per filament of 3.3 dtex, exhibit the following characteristics:

| | | |
|---|---|---|
| Tenacity | = | 34 g/tex |
| Elongation | = | 31% |

(B) The same polymer solution is spun under the same conditions as above, but with a common or ordinary spinneret of 15,000 orifices, not comprising individual spinnerets.

The "safety factor", that is, the relation between the speed of the first roll producing the breaking of the first filament and the speed of the first roll in a normal run is compared in each case for different spinning speeds.

| Spinning Speed m/min | Spinneret, Test (B) (Safety Factor) | Spinneret, Test (A) |
|---|---|---|
| 60 | 1.37 | 1.88 |
| 90 | 1.16 | 1.60 |
| 102 | 0.9 | 1.53 |

These results show that the spinneret assembly according to this invention allows the spinning speed to be increased very substantially without risk of broken end production.

EXAMPLE 2

There was spun an acrylic polymer solution having a specific viscosity of 0.400 (measured under the conditions indicated in Example 1) and containing:

| | |
|---|---|
| acrylonitrile | 94.3% by weight |
| methyl methacrylate | 5.2% by weight |
| sodium methallysulfonate | 0.5% by weight |
| dissolved in DMF at the level of | 20% by weight |

This solution is spun into a coagulating bath maintained at 5° C. containing 37% of DMF and 63% of water, by means of a commercial scale spinning machine comprising 12 spinnerets, each consisting of four cupules 19 mm in diameter and having 3,750 orifices 0.055 mm in diameter, each of these 12 spinnerets being identical to the assembly used according to Example 1, and showing the same piercing relations.

The individual spinnerets are made of a platinum-gold-rhodium alloy, the intermediate holders and the spinneret plate constituting the rigid supporting plate (according to FIG. 18) being made of polyamide.

The filaments are then dried in the air at a draw ratio of 1.8×, washed in running water, drawn in a boiling water bath at a draw ratio of 3.5×, dried (entry speed into the drying zone = 60 m/min), and steam-treated at 130° C.

The yarns thus obtained have the following characteristics:

| | | |
|---|---|---|
| Filament count | = | 3.3 dtex |
| Tenacity | = | 30 g/tex |
| Elongation | = | 31% |

The spinneret assembly employed in this example allows good spinning stability to be obtained, without broken end production in the coagulating bath.

EXAMPLE 3

A polymer solution identical to that described in Example 1 is spun through a commercial scale spinning machine consisting of 12 spinnerets identical to the single spinneret described in Example 1.

The tow produced is then treated as in Example 2 and the yarns obtained exhibit the following characteristics:

| | | |
|---|---|---|
| Filament count | = | 3.3 dtex |
| Tenacity | = | 31 g/tex |
| Elongation | = | 30% |

EXAMPLE 4

A polymer solution identical to that of Example 1 is prepared and this solution is spun through a commercial scale spinning machine consisting of 12 individual spinnerets comprising four round cups 19 mm in diameter, pierced with 1,875 orifices 0.08 mm in diameter, the piercing being carried out homogeneously.

For each of these 12 spinnerets, the piercing characteristics are as follows:

$$\frac{\text{Total piercing area}}{\text{Total surface of the assembly}} = 35.1\%$$

$$\frac{\text{Total number of orifices}}{\text{Total surface of the assembly}} = 3.275 \text{ orifices/mm}^2$$

$$\frac{\text{Total surface of orifice}}{\text{Total surface of the assembly}} = 1.65\%$$

The tow issuing from the spinneret is coagulated in a bath and treated according to the process of Example 2.

The filaments obtained show the following characteristics:

| | | |
|---|---|---|
| Count | = | 6.7 dtex |
| Tenacity | = | 28 g/tex |
| Elongation | = | 33% |

EXAMPLE 5

A polymer solution identical to that of Example 1 is prepared and spun through a commercial scale spinning machine of characteristics identical to that described in Example 4.

The polymer solution is spun into a coagulating bath containing 58% of DMF and 42% of water, maintained at 20° C.

The filaments are then drawn in the air at a ratio of 1.75×, then washed, 20% relaxed in boiling water, drawn in boiling water at a ratio of 3.47×, and dried, the entrance speed into the dryer being 60 m/min.

Filament characteristics:

| | | |
|---|---|---|
| Count | = | 6.7 dtex |
| Tenacity | = | 25 g/tex |

-continued

| Elongation | = | 32% |
|---|---|---|

This type of spinneret permits the speed in the coagulating bath to be increased without broken end production at the spinneret level, which is impossible with the usual spinnerets under the same conditions. Thus, it is possible with the same equipment to modify the process and therefore to improve the yarn characteristics.

What is claimed is:

1. A spinneret assembly comprising thin individual spinnerets simultaneously exhibiting a great mechanical resistance to pressure and a great number of orifices, in which:

the relation between the total pierced area and the total surface of the assembly is between 35% and 90%;

the relation between the total number of orifices and the total surface of the assembly is between 0.2 and 25 orifices per $mm^2$; and the relation between the total surface of orifices and the surface of the assembly is between 0.5% and 40%;

the spinneret assembly comprising a rigid supporting plate pierced with holes designed for the passage of the spinning material, every hole being coaxially associated with an individual spinneret, each hole having at least one portion of its length in which its cross sectional area is smaller than that of the respective spinneret.

2. A spinneret assembly according to claim 1, in which:

the relation between the total piercing area and the total surface of the assembly varies between 55% and 75%;

the relation between the total number of orifices and the total surface of the assembly is between 8 and 15 holes/$mm^2$ for orifices having a diameter less than or equal to 0.12 mm and between 1.5 and 6 holes/$mm^2$ for orifices having a diameter greater than 0.12 mm;

the relation between the total surface of the orifices and the total surface of the assembly varies between 2% and 4% for orifices having a diameter less than or equal to 0.12 mm and between 8% and 16% for orifices having a diameter greater than 0.12 mm.

3. A spinneret assembly according to claim 1, wherein said holes in said rigid supporting plate are each defined by an intermediate hollow holder which supports the respective individual spinneret, said supports being fixed in the holes of the rigid supporting plate.

4. A spinneret assembly according to claim 1, wherein the intermediate holders are fixed in the holes of the rigid supporting plate by screwing, riveting, sticking, brazing, or joining by forcing.

5. A spinneret assembly according to claim 1, wherein the intermediate holders are fixed in the holes of the rigid supporting plate by screwing on the inner face of the rigid supporting plate.

6. A spinneret assembly according to claim 1, wherein the intermediate holders are fixed in the holes of the rigid supporting plate by screwing by means of an intermediate piece.

7. A spinneret assembly according to claim 1, wherein the individual spinnerets are of round or polygonal cross-section.

8. A spinneret assembly according to claim 1, wherein the individual spinnerets are fixed on every intermediate holder by direct setting, set ring, welding or sticking.

9. A spinneret assembly according to claim 1, wherein the thin individual spinnerets are disposed substantially next to one another.

10. A spinneret assembly according to claim 1, wherein the individual spinnerets are completely embedded in the rigid supporting plate.

11. A spinneret assembly according to claim 1, wherein the individual spinnerets are embedded in a plastic plate or cast on the existing plate.

12. A spinneret assembly according to claim 1, wherein the spinning material supplied to each individual spinneret is canalized by means of distributing cones appropriately disposed in the rigid supporting plate or in a plastic plate or mold on the existing plate.

* * * * *